United States Patent [19]

Horie et al.

[11] Patent Number: 4,827,858

[45] Date of Patent: May 9, 1989

[54] EDGE TRACING SEWING MACHINE CAPABLE OF AUTOMATICALLY ADJUSTING NEEDLE POSITION

[75] Inventors: Fujio Horie; Takafumi Tanaka, both of Nagoya, Japan

[73] Assignee: Brother Kogyo Kabushiki Kaisha, Aichi, Japan

[21] Appl. No.: 186,113

[22] Filed: Apr. 25, 1988

[30] Foreign Application Priority Data

Apr. 28, 1987 [JP] Japan ..... 62-105388
Jun. 5, 1987 [JP] Japan ..... 62-142017

[51] Int. Cl.[4] ..... D05B 3/02

[52] U.S. Cl. ..... 112/456; 112/153; 112/306

[58] Field of Search ..... 112/153, 453, 456, 457, 112/121.11, 306, 443

[56] References Cited

U.S. PATENT DOCUMENTS 4,664,048 5/1987 Naganuma et al. ..... 112/453
4,757,773 7/1988 Nomura et al. ..... 112/153 X

FOREIGN PATENT DOCUMENTS 6268482 3/1987 Japan ..... 112/153

*Primary Examiner*—Peter Nerbun
*Attorney, Agent, or Firm*—Oliff & Berridge

[57] ABSTRACT

A sewing machine having an edge sensor for detecting an edge of a workpiece in a lateral direction perpendicular to the workpiece feed direction, and a tracing control device for controlling a relative position between a needle and the workpiece in the lateral direction to form stitches along a line a predetermined distance away from the workpiece edge. A motor to change a relative position between the workpiece edge and the sensor is operated from a first limit position to a second limit position to obtain first output signals of the sensor, and an average of a maximum and a minimum value of the first output signals is calculated. The motor is then operated from the second limit position toward the first limit position to obtain second output signals of the sensor. A first and a second average position signal are determined such that the average position signals correspond to the average value of the maximum and minimum values of the first output signals. The tracing control device is operated to adjust the relative position between the needle and the workpiece, depending upon a compensation value which is equal to a half of a difference between the values of the first and second average position signals.

4 Claims, 9 Drawing Sheets

EDGE TRACING SEWING MACHINE CAPABLE OF AUTOMATICALLY ADJUSTING NEEDLE POSITION

BACKGROUND OF THE INVENTION

1. Field of the Invention

The present invention relates to a sewing machine having a function of tracing the edge of a workpiece, and more particularly to such an edge tracing sewing machine equipped with an edge sensor which is adapted to be movable in a direction perpendicular to a feed direction of the workpiece, for detecting the workpiece edge.

2. Discussion of the Prior Art

An edge tracing sewing machine is known according to laid-open Publication No. 61-257675, the subject matter of which is incorporated in U.S. Pat. No. 4,664,048. In this sewing machine, the edge of a workpiece or work fabric is detected by an arrangement which includes (i) an edge sensor which is movable in a direction (lateral direction) perpendicular to the feed direction of the work fabric, (ii) a control motor for moving the edge sensor in the lateral direction, and thereby changing a relative position between the sensor and the fabric, and (iii) detector position control means for controlling an operation of the control motor so as to adjust the lateral position of the edge sensor so that a value of an output signal of the edge sensor coincides with a predetermined reference value, namely, so that the sensor is aligned with the edge of the fabric. Based on the detected edge position of the fabric, the lateral position of a sewing needle is regulated by a position control device. That is, a distance in the lateral direction between the fabric edge and a line of stitches to be formed is determined by a lateral distance between the fabric edge position and the needle position.

In the edge tracing sewing machine of the type described above, the reference position for positioning of the sewing needle (hereinafter simply referred to as "needle positioning") is determined by the position of the edge sensor in the lateral direction. To position the edge sensor in alignment with the fabric edge, a position control signal representative of the lateral position of the sensor is applied to the control motor.

The control motor, and a connection or linkage between the control motor and the edge sensor have mechanical gaps or clearances provided for smooth sliding or rotating actions. These gaps or clearances result in an operating play, which causes a deviation or error between the commanded and actual positions of the edge sensor. If the direction of such a deviation were fixed irrespective of the operating direction of the moving members involved, the deviation can be easily compensated for by shifting the edge sensor in the direction in which the deviation can be eliminated. In fact, the operating direction is reversed, and the direction of the deviation or error is also reversed. Accordingly, the actual position of the edge sensor corresponding to a given value of the position control signal applied to the control motor differs with the direction of scanning the fabric edge position, even if the edge position of the fabric detected by the sensor is the same. Consequently, the known arrangement suffers from a lateral positioning error of the sewing needle relative to the fabric edge, which results in inaccurate tracing of the fabric edge by the sewing needle.

SUMMARY OF THE INVENTION

It is accordingly an object of the present invention to provide an edge tracing sewing machine which is capable of automatically compensating the needle position for a deviation or error between commanded and actual positions of an edge sensor, which occurs due to reversal of the scanning direction of the sensor, in the presence of a play in the drive and power transmission system for positioning the edge sensor.

The above object may be accomplished according to the principle of the present invention which provides a sewing machine with instrumentalities for tracing the edge of a workpiece, including (a) a sewing needle supported by a frame such that the needle is endwise reciprocable in a vertical direction, (b) a feeding device for feeding the workpiece on the work bed in a feed direction, in synchronization with the endwise reciprocation of the needle, (c) an edge sensor for detecting the edge position of the workpiece in a lateral direction perpendicular to the feed direction, (d) a control motor operated within a drive range defined by a first and a second limit position, for changing a relative position between the edge position of the workpiece and a position of the edge sensor, (e) position control means for producing position control signals indicative of a plurality of positions within the drive range of the control motor, and thereby regulating a stop position of the control motor, such that the edge position of the workpiece is detected by the edge sensor, and (f) a tracing control device for controlling a relative position between the needle and the workpiece in the lateral direction, so as to form successive stitches on the workpiece, along a line which is away from the edge of the workpiece by a predetermined distance in the lateral direction inwardly of the workpiece, the instant sewing machine comprising: first scanning means for commanding the position control means to activate the control motor from the first limit position toward the second limit position, and thereby obtaining a plurality of first output signals of the edge sensor which correspond to the plurality of position control signals; memory means for storing values of the plurality of first output signals of the edge sensor, in relation with the plurality of position control signals; calculating means for calculating an average value of a maximum value and a minimum value of the values of the plurality of output signals of the edge sensor; second scanning means for commanding the position control means to activate the control motor from the second limit position toward the first limit position, and thereby obtaining a plurality of second output signals of the edge sensor which correspond to the plurality of position control signals; and determining means for determining a first average position signal which consists of one of the plurality of position control signals that corresponds to one of the plurality of first output signals of the edge sensor which is nearest to the average value, and a second average position signal which consists of one of the plurality of position control signals that corresponds to one of the plurality of second output signals which is nearest to the average value, and obtaining a compensation value which is a half of a difference between values of the first and second average position signals. The tracing control device is operated to adjust the relative position between the needle and the workpiece in the lateral direction, depending upon the compensation value.

In the sewing machine of the present invention constructed as described above, the first scanning means is adapted to command the position control means to produce the position control signals, for activating the control motor from the first limit position toward the second limit position, and thereby changing the relative position between the edge sensor and the workpiece in the lateral direction. In the meantime, the edge sensor produce first output signals which correspond to various relative positions between the sensor and the workpiece or which correspond to the position control signals. These first output signals are stored in the memory means, in relation to the position control signals. The value of the position control signals increases or decreases with a change in the relative position between the sensor and the workpiece in the predetermined lateral direction, so that the value of the position control signals represents the relative position of the sensor and the workpiece in the lateral direction.

The calculating means is adapted to retrieve a maximum value and a minimum value of the first output signals, and calculate an average value of these maximum and minimum values. The determining means then searches for one of the first output signals of the sensor which are stored in the memory means which is nearest to the calculated average value. The determining means determines a first average position signal which consists of one of the position control signals which corresponds to the above-indicated one first output signal of the edge sensor. The output signal of the sensor is maximum when the detection area aligned with the current position of the sensor is entirely uncovered by the workpiece, and is minimum when the detection area is entirely covered by the workpiece. This indicates that the value of the first output signal of the snsor which is nearest to the above-indicated average value represents the position of the sensor in which the detection area of the sensor consists of two equal divisions which are uncovered and covered by the workpiece, respectively, namely, the position in which the edge of the workpiece passes the center of the detection area of the edge sensor. In other words, the average value of the maximum and minimum values of the first output signals of the sensor is a reference value for detecting the edge of the workpiece. The thus obtained first average position signal corresponds to the workpiece edge position which is detected while the control motor is operated from the first limit position toward the second limit position.

On the other hand, the second scanning means is adapted to command the position control means to activate the control motor from the second limit position toward the first limit position, for changing the relative position of the sensor and the workpiece in a direction opposite to that described above. During this operation of the control motor, second output signals are produced by the edge sensor. Each time the second output signal is produced, the determining means compares the signal with the above-indicated average value, and determines one of the second output signals as a second average position signal, if the value of the above-indicated one second output signal is nearest to the average value. This second average position signal corresponds to the edge position of the workpiece which is detected while the control motor is operated from the second limit position toward the first limit position.

The determining means obtains a compensation value which is a half of a difference between the values of the thus obtained first and second average position signals The tracing control device is operated to adjust the relative position between the workpiece and the needle, according to the obtained compensation value.

It is possible to use memory means similar to that used for storing the first output signals of the sensor, so that one of the second output signals which is nearest to the above-indicated average value is retrieved from such memory means.

It follows from the above description of the present invention that the relative position between the workpiece and the needle is compensated for a possible deviation or error between the commanded and actual positions of the edge sensor, due to reversal of the scanning direction of the sensor, in the presence of a mechanical play in the drive and power transmission system for positioning the sensor. Accordingly, the instant sewing machine is capable of accurately positioning the sewing needle relative to the workpiece edge, thereby assuring an excellent stitching operation along a line which is spaced away from the workpiece edge by a desired constant distance.

In the present sewing machine, the operations to detect the workpiece edge by the first and second scanning means are effected based on the average of the maximum and minimum values of the first output signals of the sensor produced during scanning by the first scanning means. Therefore, even if the value of the output signal of the sensor fluctuates due to varying characteristic of the sensor or installation error of the sensor, or depending upon the specific kind of the workpiece, the reference value (average value indicated above) is changed in response to the fluctuation of the output signal, so that the accuracy of detection of the workpiece by the edge sensor is further improved.

According to one form of the invention, the determining means compares each of the values of the plurality of second output signals of the edge sensor, with the average value, while the second output signals are produced during an operation of the control motor from the second limit position toward the first limit position, and the determining means selects the above-indicated one of the second output signals as the second average position signal.

According to another form of the invention, the calculating means comprises: storing means for storing in a maximum register and a minimum register a first one of the plurality of first output signals which is produced by the edge sensor, in a first one of the plurality of positions of the control motor while the control motor is operated from the first limit position toward second limit position; maximum value updating means for comparing a second one of the first output signals, with the first one of the first output signals which is stored in the maximum register, and replacing the above-indicated first one of the first output signals stored in the first register, by the above-indicated second one of the first output signals, if a value of the second one of the first output signals is greater than a value of the first one of the first output signals, the maximum value updating means updating the value stored in the first register, by effecting comparison and replacement similar to those indicated above, with respect to third and subsequent ones of the first output signals; minimum value updating means for comparing the above-indicated second one of the first output signals, with the first one of the first output signals which is stored in the minimum register, and replacing the first one of the first output signals stored in the second register, by the second one of the first output signals, if a value of the second one of the first output signals is smaller than a value of the first one of the first output signals, the minimum value updating means updating the value stored in the minimum register, by effecting comparison and replacement similar to those indicated above, with respect to third and subsequent ones of the first output signals; and means for obtaining an average value of the maximum and minimum values of the first output signals which are stored in the maximum and minimum registers, after the control motor is operated to the second limit position.

According to a further form of the invention, the tracing control device determines the edge position of the workpiece by shifting one of two positions represented by the first and second average position signals toward the other of the two positions, by a distance corresponding to the compensation amount, and controls the relative position between the needle and the workpiece, such that the needle is located at a position which is spaced away from the determined edge position of the workpiece by the predetermined distance in the lateral direction.

BRIEF DESCRIPTION OF THE DRAWINGS

The foregoing and optional objects, features and advantages of the present invention will be better understood by reading the following detailed description of a presently preferred embodiment of the invention, when considered in connection with the accompanying drawings, in which.

DETAILED DESCRIPTION OF THE PREFERRED EMBODIMENT

The preferred embodiment of the present invention will be described in detail, by reference to the accompanying drawings.

Figure 1:
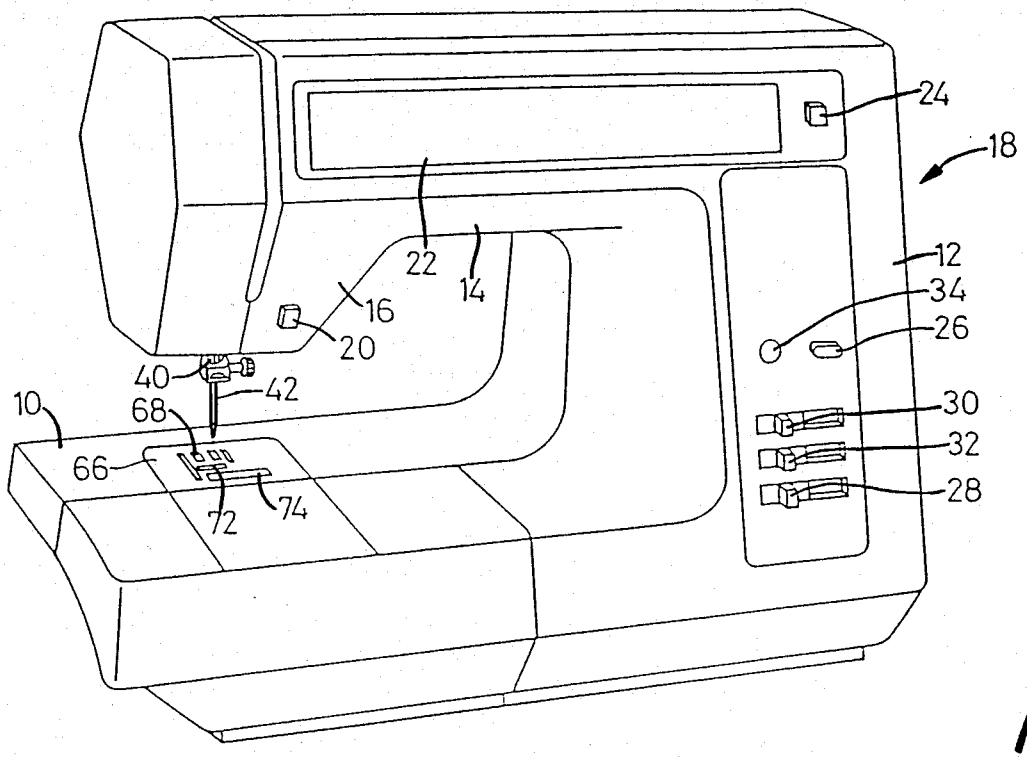
FIG. 1 is a schematic perspective view of one embodiment of an edge-tracing sewing machine of the invention, showing the exterior appearance of the sewing machine.
Figure 2:
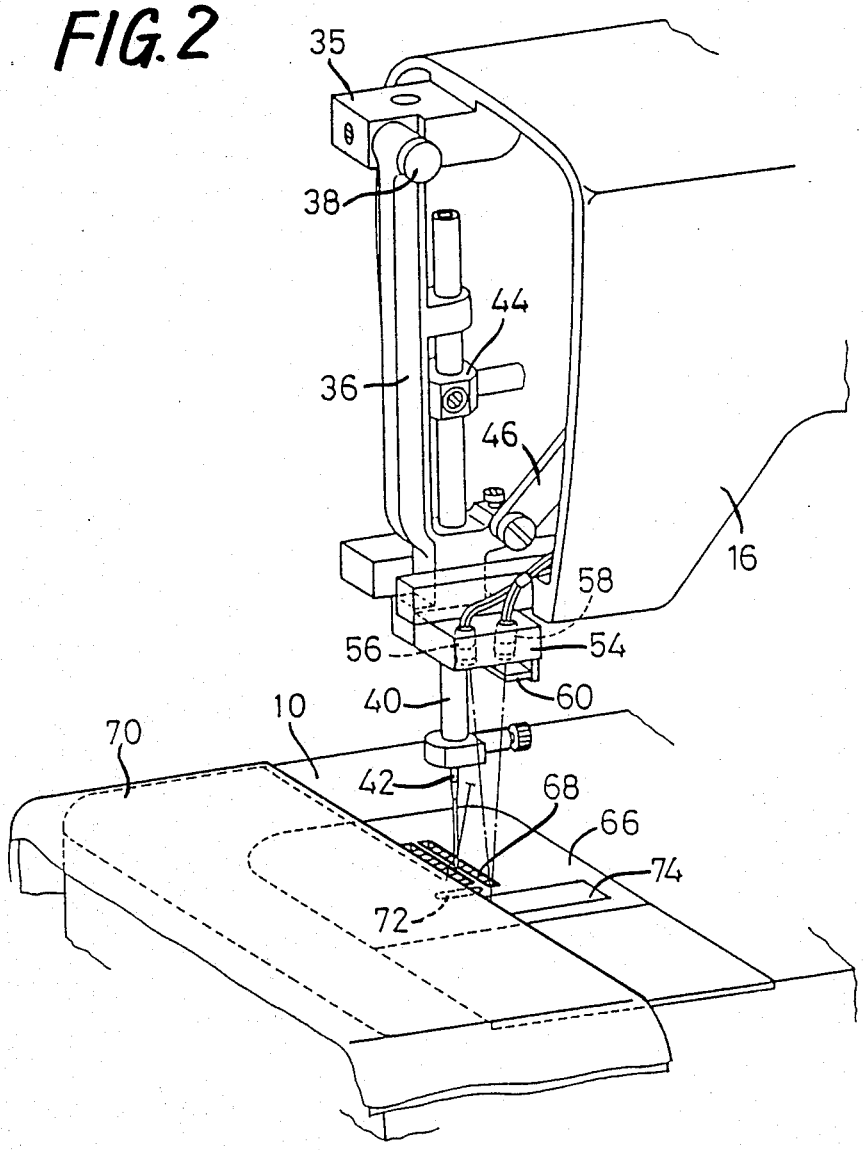
FIG. 2 is a perspective view of a head portion of the sewing machine of FIG. 1, with its head cover removed to show the interior construction of the head portion.

As shown in FIG. 1, the sewing machine according to the present embodiment includes a work bed 10 (hereinafter simply referred to "bed 10") having a flat upper surface, a standard 12 rising from the right-hand side end of the bed 10, a bracket arm 14 extending from the upper end of the standard 12 substantially in parallel with the bed 10, and a head 16 provided at the free end of the bracket arm 14. These members 10, 12, 14 and 16 are incorporated in a machine frame 18. The head 16 has a main switch 20 for turning on and off the sewing machine. The bracket arm 14 has a display panel 22 on which there are provided a plurality of indicia indicative of stitch patterns available on the instant sewing machine. The bracket arm 14 further has a pattern select switch 24 for selecting the stitch patterns. On the standard 12, there is provided a tracing-mode select switch 26 used to place the sewing machine in a tracing-mode in which a line of stitches are formed a predetermined constant distance away from the edge of a workpiece or work fabric 70 (FIG. 2). There are also provided on the standard 12: a distance setting member 28 for setting the above-indicated predetermined distance between the edge of the work fabric 70 and the line of stitches; a bight adjusting member 30; a feed adjusting member 32; and a "NEEDLE-UP" indicator 34.

Referring next to FIG. 2 showing the interior construction of the head 16 as seen with its covering member removed, there is provided a support member in the form of a needle-bar oscillator 36 which is supported at its one end by a shaft 38 on a projection 35 fixed to the head 16 such that the oscillator 36 is pivotable about the shaft 38 in the vertical plane. On this oscillator 36 is supported a needle bar 40 slidably in the vertical direction. The needle bar 40 is adapted to carry a needle 42 fixed at its lower end, and is connected to a needle drive motor (not shown) via a connecting stud 44 and other members, so that the needle bar 40 and the needle 42 are endwise reciprocated in the vertical direction during an operation of the needle drive motor. On the other hand, the needle-bar oscillator 36 is operatively connected to a bight control motor 100 (FIG. 3) via a connecting rod 46 and other members. With this bight control motor 100 operated, the needle bar 36 is jogged in a lateral direction perpendicular to a feed direction of the work fabric 70, whereby the lateral position of the needle 42 is varied within a predetermined range defined by a leftmost and a rightmost position.

On the needle-bar oscillator 36, there is mounted a sensor 54 such that the sensor is joggable together with the oscillator 36. The sensor 54 includes a light emitter 56 which emits infrared rays, and a photoelectric cell 58 which receives the reflected infrared rays as described later. In the vicinity of the photoelectric cell 58, there is disposed an optical filter 60 which permits the infrared rays to pass therethrough, but does not transmit light rays of other wavelength regions.

The upper surface of the bed 10 indicated above has an aperture closed by a throat plate 66 having a plurality of slots, through which respective feed dogs 68 are adapted to protrude above the throat plate 66. The feed dogs 68 are given feeding movements or actions by a feed control motor 98 (FIG. 3), and cooperate with a presser foot (not shown) to feed the work fabric 70 in the feed direction perpendicular to the direction of lateral jogging of the needle 42. The throat plate 66 further has an elongate needle hole 72 which is formed in the lateral jogging direction of the needle 42. In the vicinity of the needle hole 72, a reflecting surface 74 is provided on the throat plate 66, such that the length of the surface 74 is parallel to the needle hole 72. This reflecting surface 74 reflects the infrared rays emitted by the light emitter 56 of the edge sensor 54, so that the reflected rays are received by the photoelectric cell 58, as referred to above. The sensor 54 is adapted to detect a change in an amount of the infrared rays which are reflected by a predetermined detection area on the reflector surface 74. The center of the detection area lies at a point which is spaced a predetermined distance away from an intersection (hereinafter referred to as "lowered position of the needle 42") between the centerline of the needle 42 and the plane of the upper surface of the throat plate 66, in a front direction of the machine (toward the operator). The amount of light received by the photoelectric cell 58 decreases with an increase in the surface area of the detecting area which is covered by the work fabric 70. The photoelectric cell 58 generates an output signal which corresponds to the surface area of the detection area which is not covered by the work fabric 70.

Figure 3:
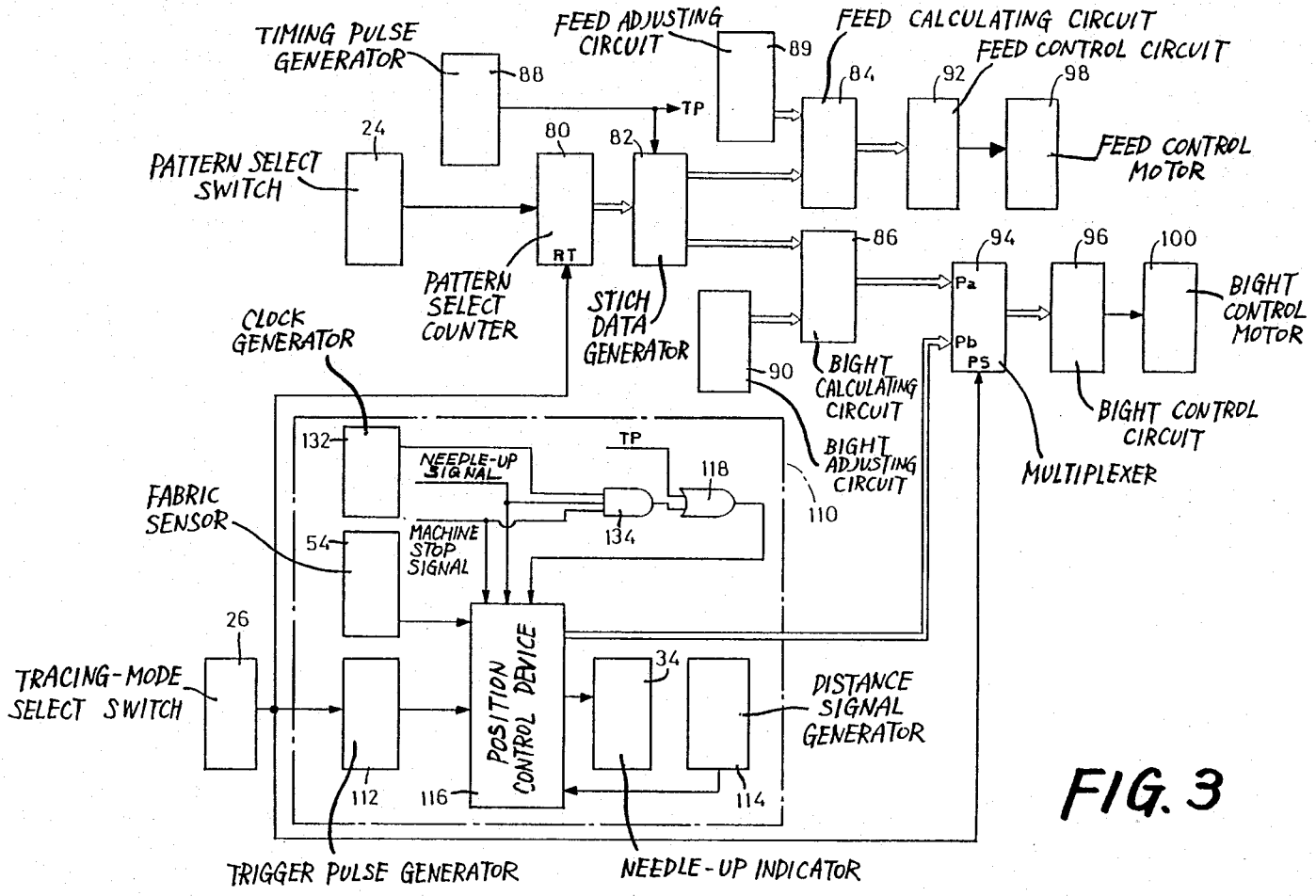
FIG. 3 is a schematic block diagram of a control system of the sewing machine.

Referring to FIG. 3, there is shown a control system of the instant sewing machine. In the figure, the pattern select switch 24 is indicated at the left-upper corner. To this select switch 24, there is connected a pattern select counter 80 which counts the number of operations of the switch 24. A signal representative of the count of the pattern select counter 80 is applied to a stitch data generator 82. According to the varying count of the counter 80, the appropriate one of light emitting diodes incorporated in the display panel 22 is turned on to indicate the currently selected stitch pattern.

The stitch data generator 82 stores sets of stitch data representative of the respective stitch patterns that can be formed in the present sewing machine. The stitch data generator 82 supplies a feed calculating circuit 84 and a bight calculating circuit 86 with the set of stitch data which corresponds to the current count of the pattern select counter 80. Described more specifically, the stitch data generator 82 is supplied with a timing pulse TP which is generated by a timing pulse generator 88 each time the needle bar 40 is reciprocated. Each time the stitch data generator 82 receives the timing pulse TP from the pulse generator 88, feed data and bight data of the stitch data are fed to the feed and bight calculating circuits 84, 86, respectively.

A feed adjusting circuit 89 is connected to the feed calculating circuit 84, while a bight adjusting circuit 90 is connected to the bight calculating circuit 86. The feed adjusting circuit 89 supplies the feed calculating circuit 84 with feed adjusting data which is variable by the feed adjusting member 32. The feed calculating circuit 84 multiplies the feed data from the generator 82, by the feed adjusting data received from the adjusting circuit 89, and a product obtained by the multiplication is fed to a feed control circuit 92, whereby the feed data of the stored stitch data for the selected stitch pattern is adjusted according to the current position of the feed adjusting member 32. Similarly, the bight calculating circuit 86 is adapted to adjust the bight data from the stitch pattern generator 82, according to bight adjusting data received from the bight adjusting circuit 90, which corresponds to the current position of the bight adjusting member 30. The bight data adjusted by the calculating circuit 86 is applied to a bight control circuit 96 via a multiplexer 94. The feed control circuit 92 controls the previously indicated feed control motor 98 to effect controlled feeding movements of the feed dogs 68, while the bight control circuit 96 controls the previously indicated bight control motor 100 to effect controlled lateral jogging movements of the needle 42. In this manner, successive stitches are formed in the pattern selected by the pattern select switch 24.

The tracing-mode select switch 26 is connected to the pattern select counter 80 and to the multiplexer 94. With this switch 26 activated, the pattern select counter 80 is reset. As a result, the stitch data representative of a straight stitch pattern is generated from the stitch data generator 82. At the same time, the multiplexer 94 is switched to a position for applying an output signal of a tracing control device 110 to the bight control circuit 96, rather than the output of the bight calculating circuit 86.

The tracing control device 110 includes: the edge sensor 54 indicated above; a trigger pulse generator 112 which produces a trigger pulse upon rising of an ON signal of the tracing-mode select switch 26; the "NEEDLE-UP" indicator 34 indicated above; and a distance signal generator 114 which produces a distance signal whose level corresponds to the current position of the distance setting member 28. Outputs of the sensor 54, trigger pulse generator 112 and distance signal generator 114 are applied to a position control device 116, which further receives a NEEDLE-UP signal, a MACHINE STOP signal, and the above-indicated timing pulse TP supplied through an OR gate 118. Based on these signals received from the various components, the position control device 116 provides the multiplexer 94 with an output signal in the form of a scanning control signal "xi" or a tracing control signal "ui", and generates a signal for turning on and off the NEEDLED-UP indicator 34.

Figure 4:
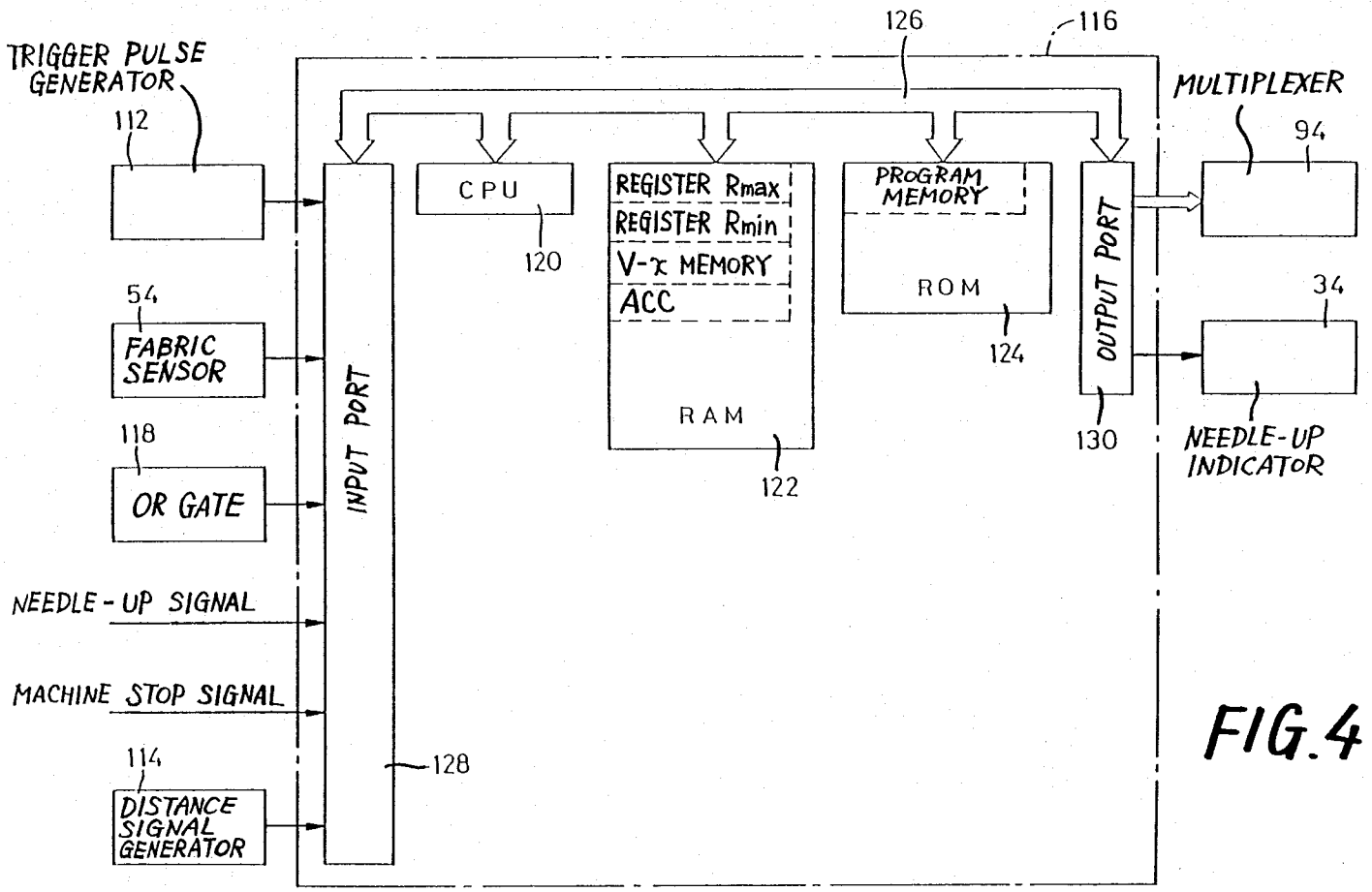
FIG. 4 is a schematic block diagram a position control device of a tracing control device of the sewing machine.
Figure 5A:
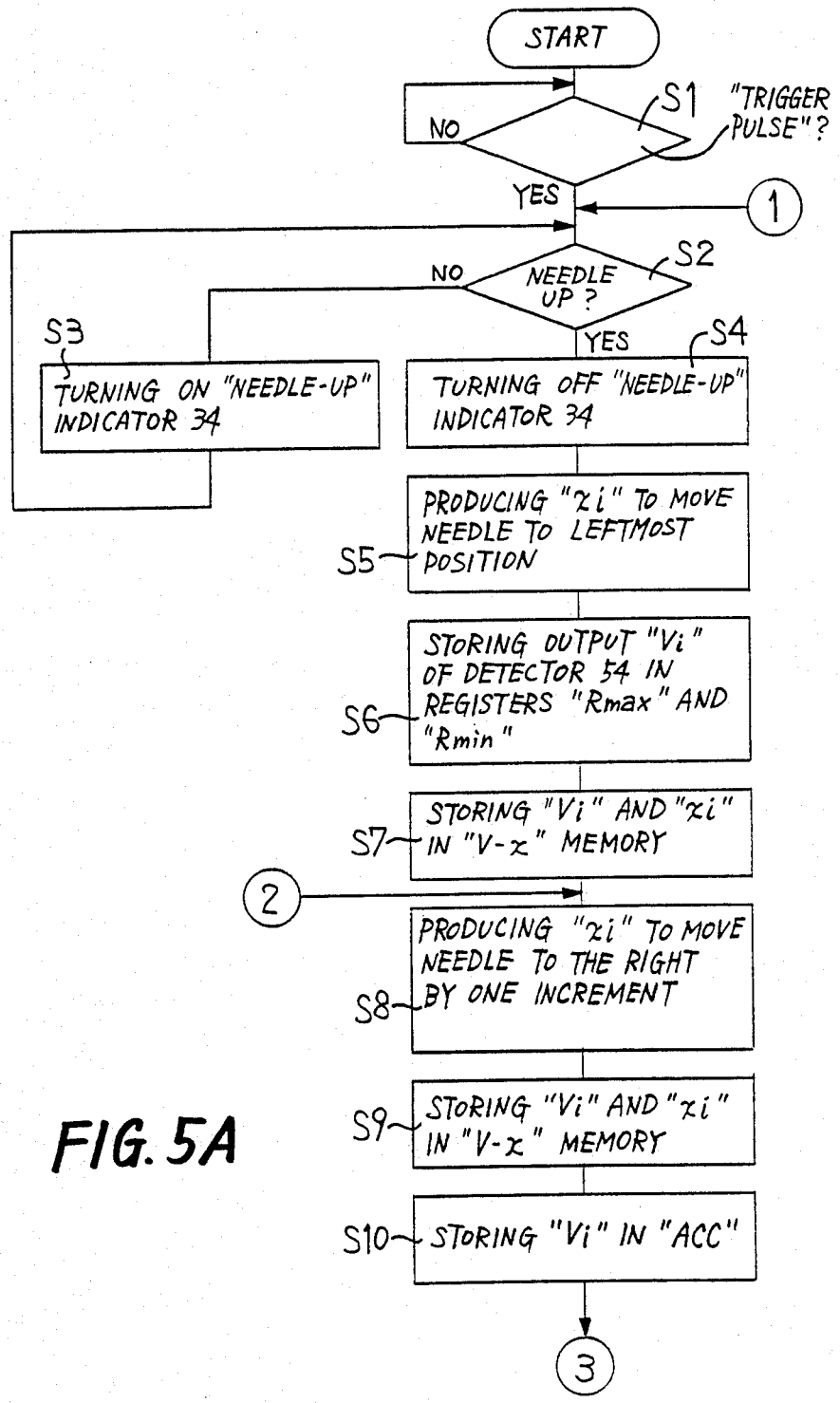
FIG. 5 is a flow chart showing a control program stored in a program memory of the position control device of FIG. 4.
Figure 5B:
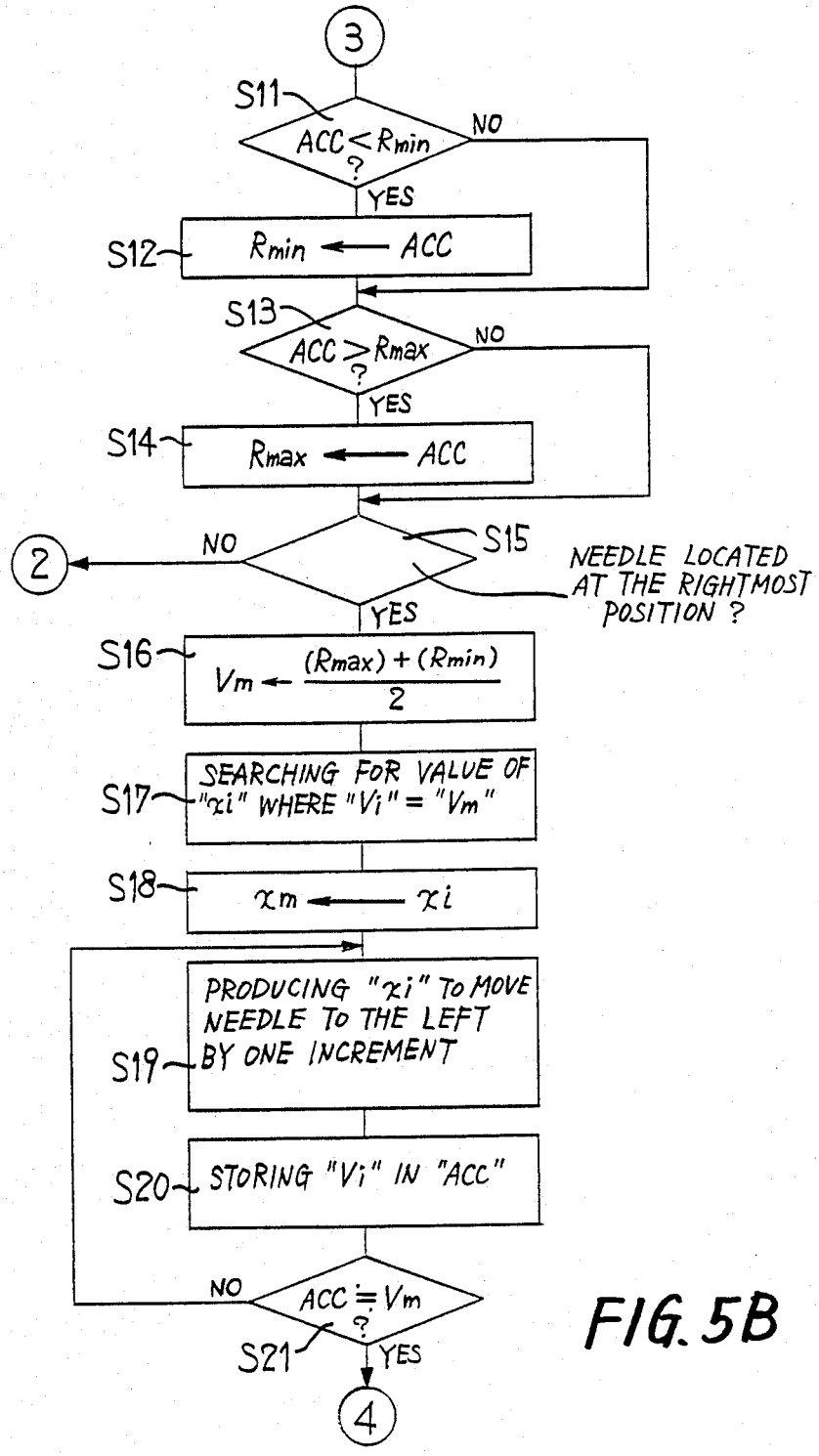
Figure 5C:
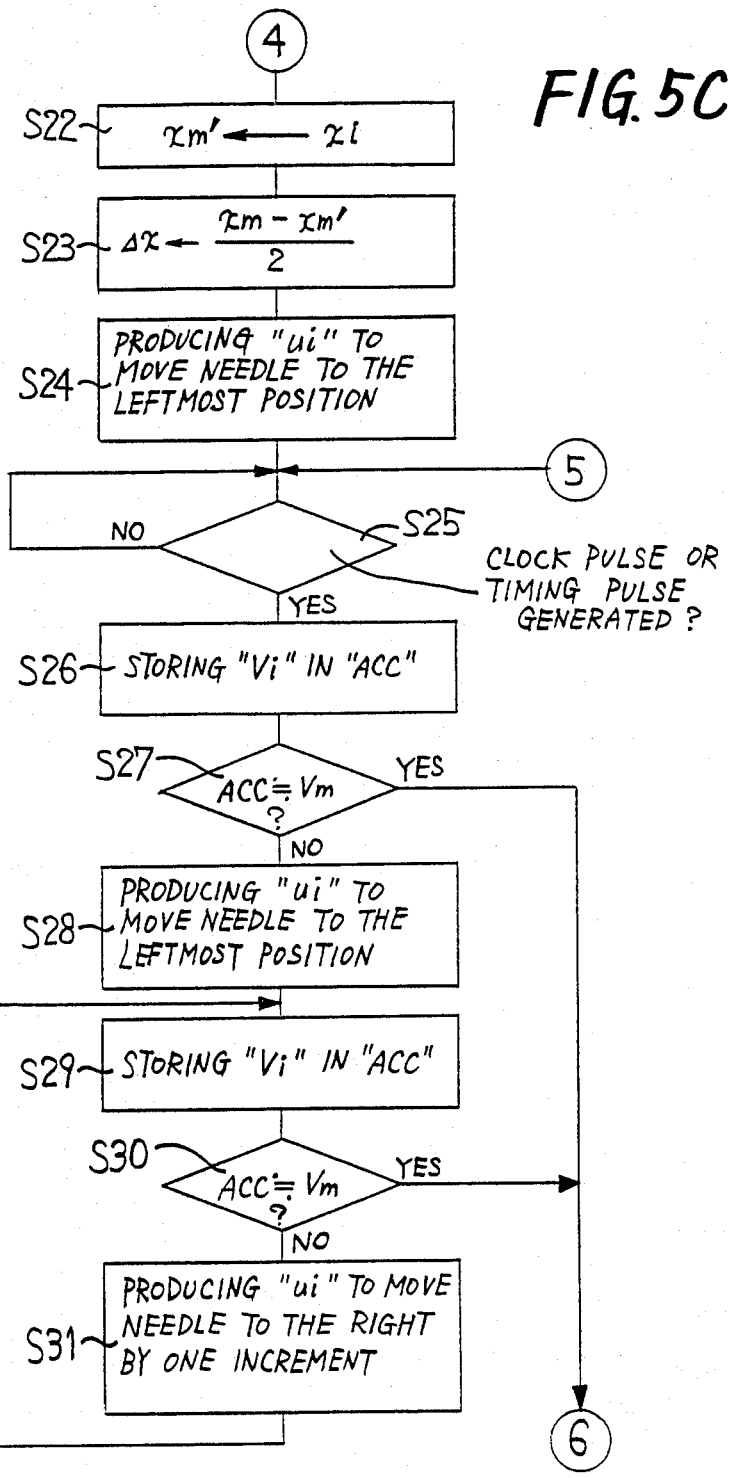
Figure 5D:
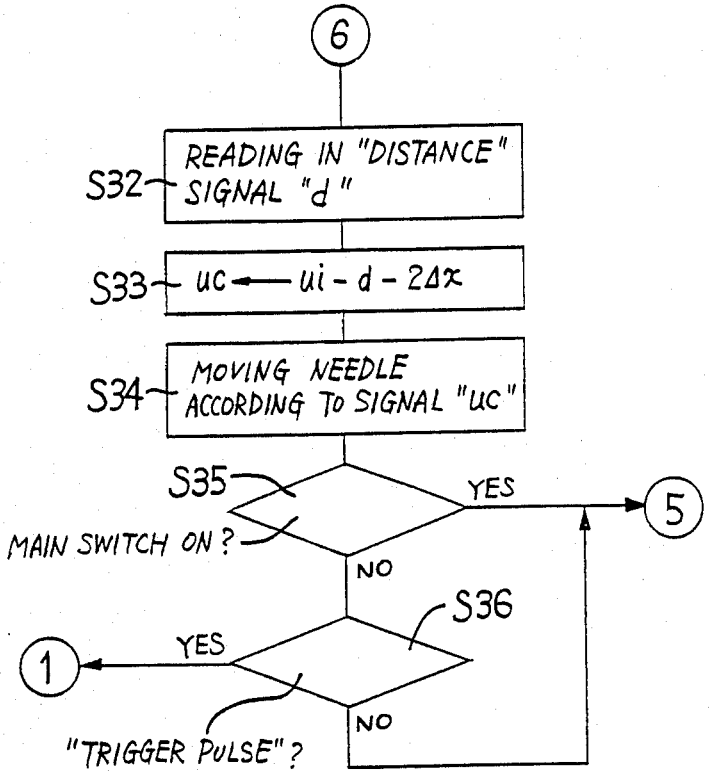

As indicated in FIG. 4, the position control device 116 consists of a microcomputer which includes a central processing unit (CPU) 120, a random access memory (RAM) 122, a read-only memory (ROM) 124, and a data bus 126. The ROM 124 includes a program memory which stores a control program for determining the scanning and tracing control signals "xi" and "ui", in a manner as illustrated in the flow chart of FIG. 5. The edge sensor 54, trigger pulse generator 112, distance signal generator 114, OR gate 118, etc. which have been discussed, are connected to an input port 128 of the position control device 110, while the multiplexer 94 and the NEEDLE-UP indicator 34 are connected to an output port 130 of the device 116.

The timing pulse generator 88 generates the timing pulse TP only while the needle bar 40 is reciprocating with the needle drive motor kept operated. A clock pulse generator 132 is provided so as to supply the position control device 116 with a clock pulse similar to the timing pulse TP, even while the sewing machine is at rest. The clock pulse from the clock generator 132 is directly applied to an input of an AND gate 134 which also receives the NEEDLE-UP signal produced while the needle 42 is placed at its elevated position, and the MACHINE STOP signal produced while the needle drive motor is at rest. The clock pulse is fed from the AND gate 134 to the OR gate 118 only when the NEEDLE-UP and MACHINE STOP signals are both applied to the AND gate 134.

In the tracing mode of operation on the sewing machine constructed as described above, the operator first sets the work fabric 70 on the upper surface of the bed 10, such that the fabric 70 is located to the left of the needle 42 and such that a desired line of stitches to be formed along the fabric edge is substantially perpendicular to the length of the elongate needle hole 72 and substantially aligned with the center of the needle hole 72. Then, the operator activates the tracing-mode select switch 26. As a result, the pattern select counter 80 is reset, and the straight stitch pattern is selected irrespective of the specific stitch pattern which has been selected. At the same time, the multiplexer 94 is switched to its position in which the output signal of the tracing control device 110 is applied to the bight control circuit 96. Further, the position control device 116 determines its output signals (scanning control signal "xi" and tracing control signal "ui"). With the scanning and tracing control signals "xi" and "ui" applied to the bight control circuit 96, the circuit 96 produces a position control signal "Xi" which corresponds to the scanning or tracing control signal "xi" or "ui", whereby the bight control motor 100 is operated according to the position control signal "Xi", to position the needle oscillator 36 in the appropriate lateral position.

The output signals of the position control device 116 are determined according to the control program illustrated in the flow chart of FIG. 5. Upon application of power to the sewing machine, the control flow first goes to step S1 in which the sewing machine is ready to perform a tracing mode of operation. If a trigger pulse is generated with the tracing-mode select switch 26 activated, an affirmative decision (YES) is obtained in step S1, and the control flow goes to step S2 to determine whether the needle 42 is placed in the elevated position. If a negative decision (NO) is obtained in step S2, step S3 is executed to turn on the NEEDLE-UP indicator 34, to prompt the operator to move the needle 42 to the elevated position. If the needle 42 is placed in the elevated position and the NEEDLE-UP signal is present, an affirmative decision (YES) is obtained in step S2, whereby step S2 is followed by step S4 to turn off the NEEDLE-UP indicator 34. Then, the control flow goes to step S5.

In step S5, a scanning control signal "xi" is applied to the multiplexer 94, so as to move the oscillator 36 (needle 42) to the leftmost position. In the next step S6, a current output signal "Vi" of the edge sensor 54 (which is positioned according to the scanning control signal "xi") is stored in a maximum register Rmax and a minimum register Rmin of the RAM 122. Step S6 is followed by step S7 in which the output signal "Vi" of the sensor 54 and the scanning control signal "xi" are stored in a V-x memory of the RAM 122, in relation with each other. In the present embodiment, the V-x memory serves as memory means for storing the output signals "Vi" and the scanning control signals "xi".

Figure 6:
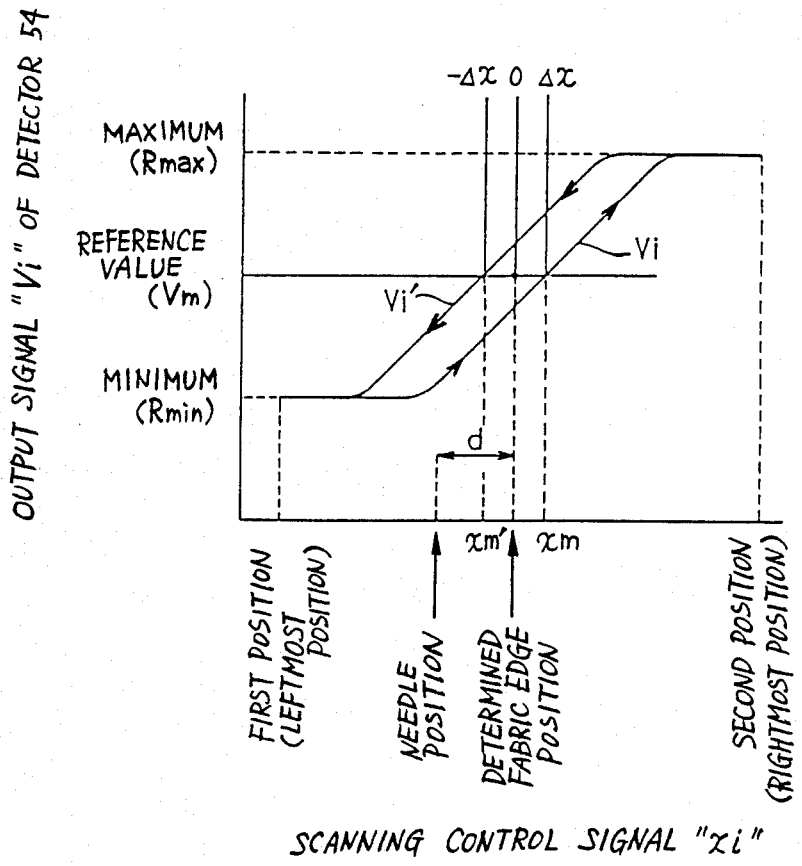
FIG. 6 is a graph illustrating a relationship between an output signal of an edge sensor and a scanning control signal produced by the position control device.

In the next step S8, another scanning control signal "xi" is generated to move the oscillator 36 to the right by one increment. In the present embodiment, a distance between the leftmost and rightmost positions consists of 28 equal divisions or incremental unit distances. The leftmost and rightmost positions correspond to a first and a second limit position which define a predetermined operation range of the bight control motor 100. In step S9, the output signal "Vi" at the current position of the oscillator 36 is stored in the V-x memory of the RAM 122, in relation with the scanning control signal "xi". It is noted that the oscillator 36 is moved from left to right as the value of the scanning control signal "xi" increases. That is, the value of the scanning control signal "xi" represents the lateral position of the oscillator 36. In the next step S10, the output signal "Vi" is stored in an accumulator (hereinafter abbreviated as "ACC") of the RAM 122. Then, the control flow goes to step S11 to determine whether the value in the ACC is smaller than the value in the minimum register Rmin. If the value in the ACC is smaller than the value in the minimum register Rmin, step S12 is executed to replace the value in the minimum register Rmin by the value in the ACC. If not, the above replacement will not take place. In the next step S13, a determination is made as to whether the value in the ACC is greater than the value in the maximum register Rmax. If an affirmative decision (YES) is obtained in step S13, step S14 is executed to replace the value in the maximum register Rmax by the value in the ACC. If a negative decision (NO) is obtained in step S13, the above replacement in step S14 will not take place. The above steps S8 through S14 are repeatedly executed until the oscillator 36 is placed in the rightmost position, namely, until an affirmative decision (YES) is obtained in step S15 in which a determination is made as to whether the needle oscillator 36 (needle 42) is placed in the rightmost position. Eventually, the minimum value and the maximum value of the output signal "Vi" of the edge sensor 54 are stored in the respective minimum and maximum registers Rmin and Rmax. Since the output signal "Vi" of the sensor 54 represents a change in the surface area of the detection area of the edge sensor 54 which is not covered by the work fabric 70, the value of the output signal "Vi" is minimum when the entire detection area is covered by the fabric 70. On the other hand, the value of the output signal "Vi" is maximum when the entire detection area is uncovered by the fabric 70. In other words, the value of the output signal "Vi" varies in relation with the scanning signal "xi", as illustrated in FIG. 6.

In step S16, the position control device 116 calculates an average value of the minimum and maximum values stored in the minimum and maximum registers Rmin and Rmax. The calculated average value is used as a reference value "Vm". Where the edge of the fabric 70 is located in the center of the detection area of the sensor 54, a half of the detection area is covered by the fabric 70, and the other half is uncovered by the fabric 70 (namely, the other half is exposed to the reflecting surface 74, in the present embodiment). In step S17, the position control device 116 searches for one of the values of the scanning control signal "xi" (stored in the V-x memory of the RAM 122), which corresponds to one of the values of the output signals "Vi" (stored in the V-x memory) that is nearest or equal to the reference value "Vm". In step S18, the searched value "xi" is determined as a first scanning control signal "xm" which is considered to represent the edge position of the fabric 70. If the first scanning control signal "xm" is applied to the bight control circuit 96, a first average position signal "Xm" corresponding to the first scanning control signal "xm" is applied as a position control signal Xi to the bight control motor 100.

Then, the control flow goes to step S19 wherein the scanning control signal "xi" is produced so as to move the oscillator 36 to the left by one increment. In the following step S20, the current value of the output signal "Vi" of the sensor 54 is stored in the ACC of the RAM 122. Steps S19 and S20 are repeatedly implemented until the value of the output signal "Vi" (value stored in the ACC) becomes equal to the reference value "Vm", that is, until an affirmative decision (YES) is obtained in step S21. If an affirmative decision is obtained in step S21, step S22 is implemented to determine the current value "xi" as a second scanning control signal "xm'". If this second scanning control signal "xm'" is applied to the bight control circuit 96, a second average position signal "Xm'" corresponding to the second scanning control signal "xm'" is applied as a position control signal Xi to the bight control motor 100.

In the next step S23, the value of the second scanning control signal "xm'" is subtracted from the value of the first scanning control signal "xm", and the obtained difference is divided by 2. The obtained result or quotient is determined as a compensation value Δx. Namely, the compensation value Δx is a difference between the average value "xi" of the first and second scanning control signals "xm" and "xm'" (which is considered to represent the edge position of the fabric 70), and the value of the first or second scanning control value "xm" or "xm'", as indicated in FIG. 6. Then, in step S24, the appropriate tracing control signal "ui" is produced to return the oscillator 36 (needle 42) to the leftmost position.

Then, the control flow goes to step S25 wherein the position control device 116 is ready to receive the clock pulse from the clock pulse generator 132 or the timing pulse TP from the timing pulse generator 88. Since the main switch 20 is not in the operated position at the present point of time, the clock pulse from the clock pulse generator 132 is applied to the position control device 116 via the AND gate 134 and the OR gate 118. As a result, an affirmative decision (YES) is obtained in step S25. Accordingly, step S26 is executed to store the output signal "Vi" of the sensor 54 in the ACC of the RAM 122. Step S26 is followed by step S27 to determine whether the value stored in the ACC is almost equal to the reference value "Vm", that is, to determine whether the sensor 54 has been correctly positioned to detect the edge of the fabric 70. If a negative decision (NO) is obtained in step S27, step S28 is implemented to produce the appropriate tracing control signal "ui" in order to move the oscillator 36 (needle 42) to the leftmost position. Then, step S29 is executed to store the output signal "Vi" of the sensor 54 in the ACC. Step S29 is followed by step S30 to determine whether the current value of the output signal "Vi" (value currently stored in the ACC) is almost equal to the reference value "Vm". If not, the control flow goes to step S31 wherein the tracing control signal "ui" is produced so as to move the oscillator 36 to the right by one increment, and the control flow goes back to step S29. Steps S29 through S31 are repeatedly executed until an affirmative decision (YES) is obtained in step S30. If an affirmative decision is obtained in step S30, the control flow goes to step S32, which is also executed where an affirmative decision is obtained in step S27.

In step S32, the position control device 116 reads in a DISTANCE signal "d" generated by the distance signal generating device 114. Then, step S33 is executed to subtract the value of the distance value "d" and the value of 2Δx (compensation value Δx multiplied by 2) from the value of the current tracing control signal "ui". It follows from the graph of FIG. 6 that the position of the needle 42 which is spaced away from the determined edge position ("ui"−Δx) by a distance of "d" is represented by [("ui"−Δx)−"d"]. In the present embodiment wherein the needle 42 (needle oscillator 36) is moved together with the edge sensor 54, however, it is necessary that the multiplexer 94 receive a compensated tracing control signal "uc" which represents a position which is spaced away from the position represented by [("ui"−Δx)−"d"], by a further distance of Δx, in the leftward direction. In other words, the compensated tracing control signal "uc" is determined in step S33 by subtracting ("ui"−"d"−2Δx) from the value of the current tracing control signal "ui".

In the next step S34, the oscillator 36 is moved according to the compensated tracing control signal "uc" to position the needle 42 in place relative to the edge of the fabric 70. Step S34 is followed by step S35 wherein the position control device 116 is ready to receive a signal from the main switch 20. If a negative decision (NO) is obtained in step S35 with the main switch 20 kept off, the control flow goes to step S36 in which the position control device 116 is ready to receive a trigger pulse from the trigger pulse generator 112. If the tracing-mode select switch 26 is once turned off and again turned on in this condition, a trigger pulse is generated from the generator 112, and an affirmative decision (YES) is obtained in step S36, whereby the control flow goes back to step S2. As a result, the compensation value Δx is again determined in the same manner as described above. If the operations of the select switch 26 described above do not take place, a negative decision (NO) is obtained in step S36, and the control flow goes to step S25.

It is noted that the frequency at which the clock pulses are received by the position control device 116 is determined so that the time interval between the two successive clock pulses is sufficient to permit the oscillator 36 to be moved or pivoted until the output signal "Vi" of the edge sensor 54 coincides with the reference value "Vm", and to permit the needle 42 to be positioned in place.

As described above, the position of the oscillator 36 is changed, and the lateral position of the needle 42 is accordingly changed, so that the lowered position of the thus positioned needle 42 corresponds to the value "d" of the distance signal received from the distance signal generator 114. If the operator wishes to change the thus established lateral position of the needle 42, the value "d" of the distance signal from the distance signal generator 114 is changed by manipulating the distance setting member 28 as needed. Based on the newly established value "d" of the distance signal, the compensated tracing control signal "uc" is determined in step S33, and the lateral position of the oscillator 36 is changed in step S34 according to the newly determined compensated tracing control signal "uc". Consequently, the lowered position of the needle 42 is changed. After the desired position of the needle 42 is established as described above, the main switch 20 is activated to start the sewing machine. As a result, an affirmative decision (YES) is obtained in step S35, and an edge tracing stitching operation is performed to form successive stitches along a line which is spaced a desired distance away from the edge of the fabric 70. Each time an affirmative decision (YES) is obtained in step S25, that is, each time a timing pulse TP from the timing pulse generator 88 is received, step S26 and the subsequent steps are implemented. As in an ordinary sewing operation, the stitch size is determined by the feed data generated by the stitch data generator 82, and the feed adjusting data generated by the feed adjusting circuit 89.

While stitches are formed with a feeding movement of the work fabric 70, the operator manipulates the fabric so as to maintain the edge of the fabric almost at the predetermined position. Nevertheless, the edge position of the fabric is unavoidably varied to some extent. In this case, however, the output signal "Vi" of the edge sensor 54 deviates from the reference value "Vm", whereby a negative decision (NO) is obtained in step S27. Consequently, steps S28 through S31 are executed during the stitching operation, in the same manner as described above with respect to the pre-sewing operation with the machine at rest. Therefore, the lateral positions of the oscillator 36 and the needle 42 are changed so that the output signal "Vi" of the sensor 54 coincides with the reference value "Vm". Further, steps S32–S34 are implemented to position the oscillator 36 and the needle 42, according to the distance signal "d". Thus, the lateral position of the needle 42 is automatically changed in response to a change in the edge position of the fabric 70, so that the distance between the line of stitches and the fabric edge is kept substantially equal to the predetermined constant value "d".

As described above, the position control device 116 is adapted to execute S24 and S28–S31 wherein the oscillator 36 is once moved to the leftmost position and then moved to the right in an incremental manner, to position the edge sensor 54. These steps are executed, since the significance or meaning of the compensation value Δx varies with the direction of an increase in the value of the tracing control signal "ui", manner of calculation of the compensation value Δx in step S23, and manner of determination of the compensated tracing control signal "uc" in step S33. Similar results will be obtained even where the oscillator 36 is moved to the left in an incremental manner after the oscillator 36 is once moved to the rightmost position, provided that the increasing direction of the tracing control signal "ui", manner of calculation of the compensation value in step S23, and manner of determination of the compensated tracing control signal "uc" in step S33 are accordingly changed.

It follows from the foregoing description that: (a) the portion of the position control device 116 assigned to execute steps S24–S31, the multiplexer 94 and the bight control circuit 96 constitute position control means for producing position control signals in the form of the tracing control signal "ui" for controlling the bight control motor 100; (b) the portion of the position control device 116 assigned to execute steps S5, S7–S9 and S15 constitutes first scanning means for activating the control motor 100 from its first limit position corresponding to the leftmost position of the needle 42, toward its second limit position corresponding to the rightmost position, to obtain the output signals "Vi" of the edge sensor 54; (c) the portion of the position control device 116 assigned to execute steps S19 and S20 constitutes second scanning means for activating the control motor 100 from its second limit position toward its first limit position, to obtain the output signals "Vi"; (d) the portion of the position control device 116 assigned to execute steps S6, S10–S14 and S16 constitutes calculating means for calculating the average value of the maximum and minimum output signals "Vm" obtained during the rightward movement of the needle 42; (e) the portion of the position control device 116 assigned to execute steps S17, S18, and S21–S23 constitutes determining means for determining the first average position signal "Xm" based on the calculated average value, and the second average position signal "Xm'" based on the output signals "Vi" obtained during the leftward movement of the needle 42; and (f) the portion of the position control device 116 assigned to execute steps S32–S34, multiplexer 94, bight control circuit 96 and bight control motor constitute the tracing control device for controlling a relative movement between the needle 42 and the fabric 70 in the lateral direction perpendicular to the feed direction of the fabric 70.

The instant presently preferred embodiment is adapted such that the edge sensor 54 and the needle 42 are moved together as a unit by the bight control motor 100, relative to the machine frame 18. However, the principle of the present invention is equally applicable to other types of an edge tracing sewing machine. For example, the present invention may be embodied such that the needle 42 and the edge sensor 54 are moved independently of each other, relative to the machine frame 18. Further, the invention may be embodied such that the needle 42 is moved by a first control motor relative to the frame 18, while the sensor 54 is moved by a second control motor relative to the needle 42. In the case where the needle 42 and the sensor 54 are moved independently of each other, the position control device 116 implements step S34, for the control motor for moving the needle 42, and step S33 wherein the tracing control signal "ui" represents the lateral position of the needle 42. In the case where the sensor 54 is moved relative to the needle 42 which is moved relative to the frame 18, the position control device 116 executes steps S5, S8, S19, S24, S28 and S31, for the second control motor for moving the sensor 54 relative to the needle 42. In this case, the sum of the value "d" of the distance signal and the compensation value Δx represents a bight control signal equivalent to the tracing control signal "ui" in step S33, and the first control motor is operated according to that bight control signal, to position the needle 42.

In the illustrated embodiment, the distance signal generator 114 produces the distance signal "d" whose value is selectable through the distance setting member 28. However, the distance "d" may be changed by changing the relative position between the needle 42 and the edge sensor 54, in the lateral direction. In this instance, the distance "d" is determined by the lateral distance between the needle 42 and the sensor 54. If it is not desired to change the distance "d", the position control device 116 may be adapted to receive the same distance signal, or the lateral distance between the needle 42 and the sensor 54 may be held constant.

In the illustrated embodiment, the relative position between the needle 42 and the fabric 70 is changed by moving the needle 42 relative to the fabric 70, and the relative position between the sensor 54 and the fabric 70 is changed by moving the sensor 54 relative to the fabric 70. However, these relative positions may be changed by moving the fabric 70 relative to the needle 42 and sensor 54.

Also, in the illustrated embodiment, the first and second scanning means produce the scanning control signal "xi", and the position control means applies to the bight control motor 100 the position control signal "Xi" which corresponds to the scanning control signal "xi". However, it is possible that the first and second scanning means merely command the sensor 54 to be moved from right to left, or from left to right, while the position control means supplies the bight control motor 100 with a position control signal which corresponds to the command generated by the scanning means. In this case, the first and second scanning means receive from the position control means the position control signal which represents a stop position of the bight control motor 100, and supplies this position control signal to the memory means and determining means.

Further, the illustrated embodiment is adapted such that the tracing control signal "ui" is compensated by the position control device 116, and the bight control circuit 96 determines the position control signal "Xi" depending upon the compensated tracing control signal "ui". However, it is possible that the position control device 116 supplies the bight control circuit 96 with the tracing control signal "ui" and the compensation value Δx, while the bight control circuit 96 converts the distance signal "d" from the generator 114, the tracing control signal "ui" from the device 116, and the compensation value Δx, into respective signals D, Xi and ΔX which represent lateral relative positions between the needle 42 and the fabric 70. In this case, the bight control circuit 96 determines a position control signal, by subtracting the values ΔX and D from the value Xi.

In the illustrated embodiment, the position of the needle 42 may be changed responsive to an operation of the distance setting member 28 even while the machine is at rest. If this arrangement is not desired, the clock pulse generator 132 and the AND gate 134 may be eliminated.

In the illustrated embodiment, the straight stitch pattern is automatically selected when the tracing-mode select switch is turned on. This arrangement is based on the tendency of using straight stitches when sewing the fabric along its edge. However, other stitch patterns may be used in the edge tracing mode according to the present invention. In this case, the distance signal "d" may be changed based on the stitch data, each time the needle 42 is endwise reciprocated, for example.

While the control system, except for the position control device 116, is constituted by discrete electronic components or circuits, the entirety of the control system may be constituted by a microcomputer. Further, the position control device 116 may consists of discrete electronic circuits.

It will be understood that the present invention may be embodied with various other changes, modifications and improvements, which may occur to those skilled in the art, in connection with the specific construction of the edge sensor 54, tracing control device 110, or mechanism for laterally jogging the needle 42, or the overall arrangement of the zigzag sewing machine. For instance, the needle 42 may be laterally jogged by pivoting the oscillator 36 about a substantially vertical axis.

What is claimed is:

1. A sewing machine having means for tracing the edge of a workpiece, including (a) a sewing needle supported by a frame such that the needle is endwise reciprocable in a vertical direction, (b) a feeding device for feeding the workpiece on the work bed in a feed direction, in synchronization with the endwise reciprocation of the needle, (c) an edge sensor for detecting the edge position of the workpiece in a lateral direction perpendicular to said feed direction, (d) a control motor operated within a drive range defined by a first and a second limit position, for changing a relative position between said edge position of the workpiece and a position of said edge sensor, (e) position control means for producing position control signals indicative of a plurality of positions within said drive range of said control motor, and thereby regulating a stop position of said control motor, such that the edge position of the workpiece is detected by said edge sensor, and (f) a tracing control device for controlling a relative position between said needle and said workpiece in said lateral direction, so as to form successive stitches on said workpiece, along a line which is away from the edge of the workpiece by a predetermined distance in said lateral direction inwardly of the workpiece, said sewing machine comprising:

first scanning means for commanding said position control means to activate said control motor from said first limit position toward said second limit position, and thereby obtaining a plurality of first output signals of said edge sensor which correspond to said plurality of position control signals;

memory means for storing values of said plurality of first output signals of the edge sensor, in relation with said plurality of position control signals;

calculating means for calculating an average value of a maximum value and a minimum value of the values of said plurality of output signals of said edge sensor;

second scanning means for commanding said position control means to activate said control motor from said second limit position toward said first limit position, and thereby obtaining a plurality of second output signals of said edge sensor which correspond to said plurality of position control signals; and determining means for determining a first average position signal which consists of one of said plurality of position control signals that corresponds to one of said plurality of first output signals of said edge sensor which is nearest to said average value, and a second average position signal which consists of one of said plurality of position control signals that corresponds to one of said plurality of second output signals which is nearest to said average value, and obtaining a compensation value which is a half of a difference between values of said first and second average position signals, said tracing control device being operable to adjust said relative position between said needle and said workpiece in said lateral direction, depending upon said compensation value.

2. A sewing machine according to claim 1, wherein said determining means compares each of the values of said plurality of second output signals of said edge sensor, with said average value, while said second output signals are produced during an operation of said control motor from said second limit position toward said first limit position, said determining means selecting said one of said plurality of second output signals as said second average position signal.

3. A sewing machine according to claim 1, wherein said calculating means comprises:

storing means for storing in a maximum register and a minimum register a first one of said plurality of first output signals which is produced by said edge sensor in a first one of said plurality of positions of said control motor while said control motor is operated from said first limit position toward second limit position;

maximum value updating means for comparing a second one of said first output signals with said first one of said first output signals which is stored in said maximum register, and replacing said first one of said first output signals stored in said first register, by said second one of said first output signals, if a value of said second one of said first output signals is greater than a value of said first one of said first output signals, said maximum value updating means updating the value stored in said first register by effecting comparison and replacement similar to those indicated above, with respect to third and subsequent ones of said first output signals;

minimum value updating means for comparing said second one of said first output signals with said first on of said first output signals which is stored in said minimum register, and replacing said first one of said first output signals stored in said second register, by said second one of said first output signals, if a value of said second one of said first output signals is smaller than a value of said first one of said first output signals, said minimum value updating means updating the value stored in said minimum register by effecting comparison and replacement similar to those indicated above, with respect to third and subsequent ones of said first output signals; and means for obtaining an average value of the maximum and minimum values of said first output signals which are stored in said maximum and minimum registers, after said control motor is operated to said second limit position.

4. A sewing machine according to claim 1, wherein said tracing control device determines said edge position of said workpiece by shifting one of two positions represented by said first and second average position signals toward the other of said two positions by a distance corresponding to said compensation amount, and controls said relative position between said needle and said workpiece, such that said needle is located at a position which is spaced away from said determined edge position of the workpiece by said predetermined distance in said lateral direction.

* * * * *